US005722599A

United States Patent [19]

Fries

[11] Patent Number: 5,722,599

[45] Date of Patent: Mar. 3, 1998

[54] SIDEWALL FIRE SPRINKLER HEAD

[75] Inventor: Michael Allen Fries, Coopersburg, Pa.

[73] Assignee: Central Sprinkler Corporation, Lansdale, Pa.

[21] Appl. No.: 603,535

[22] Filed: Feb. 21, 1996

[51] Int. Cl.[6] ..... B05B 1/26; A62C 37/08

[52] U.S. Cl. ..... 239/504; 239/518; 169/37

[58] Field of Search ..... 239/75, 200, 208, 239/504, 518, 521, 522; 169/37, 41

[56] References Cited

U.S. PATENT DOCUMENTS

| | | | |
|---|---|---|---|
| 1,507,350 | 9/1924 | Franzen . | |
| 2,046,169 | 6/1936 | Knight | 239/504 |
| 2,101,694 | 12/1937 | Tyden . | |
| 2,199,142 | 4/1940 | Russell | 239/504 X |
| 3,880,239 | 4/1975 | Vorkapich | 239/521 X |
| 4,296,815 | 10/1981 | Mears | 239/504 X |
| 4,296,816 | 10/1981 | Fischer | 239/500 |
| 4,585,069 | 4/1986 | Whitaker | 239/504 X |
| 4,624,414 | 11/1986 | Ferrazza | 239/504 X |
| 4,625,915 | 12/1986 | Cockman | 239/390 X |
| 4,987,957 | 1/1991 | Galaszewski | 239/498 X |

OTHER PUBLICATIONS

Central Sprinkler Co. Catalog Sheet No. HEC-12EC.1, entitled "OMEGA HEC-12EC", (Oct. 1991), 4 pages.

Central Sprinkler Co. Catalog Sheet No. HEC-12RES.0, entitled "OMEGA HEC-12RES", (Jan. 1992), 4 pages.

Central Sprinkler Co. Catalog Sheet No. HEC-20.1, entitled "OMEGA HEC-20", (Mar. 1992), 4 pages.

Central Sprinkler Co. Catalog Sheet No. HEC-12PRO.1, entitled "OMEGA HEC-12 PRO Prohibitor™", (Jul. 1992), 4 pages.

Central Sprinkler Co. Catalog Sheet No. 3-9.0, entitled "GB-LO 17/32", (Sep. 1993), 4 pages.

Central Sprinkler Co. Catalog Sheet No. 3-10.0, entitled "GB-QR", (Sep. 1993), 4 pages.

Central Sprinkler Co. Catalog Sheet No. 4-2.0, entitled "GBR •Sidewall •Recessed Sidewall" (Sep. 1993), 4 pages.

Central Sprinkler Co. Catalog Sheet No. 3-8.0, entitled "GB Sidewall", (Jan. 1994), 4 pages.

Central Sprinkler Co. Catalog Sheet No. 2-16.0, entitled "H17/32 Sidewall and Recessed Sidewall", (Apr. 1994), 4 pages.

Central Sprinkler Co. Catalog Sheet No. 2-15.0, entitled "Sidewall Sprinkler-H", (Aug. 1994), 4 pages.

*Primary Examiner*—Lesley D. Morris

*Attorney, Agent, or Firm*—Panitch Schwarze Jacobs & Nadel, P.C.

[57] ABSTRACT

A sidewall fire sprinkler head includes a frame with tubular body and a deflector supported from the frame. The deflector has a face portion, generally planar, which is supported generally perpendicularly to a longitudinal central axis of the frame, and a generally planar canopy portion, which is supported from the face portion on an upper side of the face portion and oriented generally horizontally when the sprinkler is installed. An opening between the face portion and the canopy portion permits water to pass through the deflector and be directed by the canopy portion to the remote side of the protected area directly opposite the sprinkler from the remote corners of the protected area. At least one additional opening is provided on the lower side of the face portion below the central axis. A fin portion of the deflector is provided positioned transversely to the face portion and forming a lower side on the additional opening to direct water discharged away from the central axis and downwardly towards the opening through the deflector generally parallel to the central axis and even back up towards the central axis to supplement the water being directed to the remote area directly opposite the head.

20 Claims, 2 Drawing Sheets

SIDEWALL FIRE SPRINKLER HEAD

FIELD OF THE INVENTION

The present invention relates to fire sprinkler heads and, in particular, to sidewall or horizontal sprinklers.

BACKGROUND OF THE INVENTION

Sidewall or horizontal sprinkler heads are mounted on the vertical walls of a building or a room, typically at a location near the ceiling. The most common sidewall sprinkler head includes a frame with a tubular body and a pair of arms which extend outwardly from a discharge end of the body to a "junction" or "boss" or "joint" where the ends of the arms meet and on which a deflector is mounted. Typically, sidewall sprinkler deflectors have two major portions. A generally planar and more generally vertical than horizontal face portion faces the discharge end of the body and is supported on the arm junction. A generally planar and more generally horizontal than vertical canopy portion is typically supported above the face portion. The lower surface of the canopy portion is positioned and shaped to limit the upward trajectory of water discharged from the body as well as to distribute it laterally over the portions of the protected area which is most remote to the sprinkler. The face portion has a surface which is shaped to distribute some of the water laterally to the sides of and below the sprinkler, as well as back towards the sidewall supporting the sprinkler.

For sprinkler heads to have any significant commercial value in the United States, they must be listed or approved by an independent testing laboratory. For example, Underwriters Laboratories, Inc. provides listings for fire sprinklers which meet certain minimum requirements. Underwriters Laboratories, Inc. Standard for Residential Sprinklers for Fire-Protection Service, UL 1626, requires the successful completion of a variety of tests, including certain water distribution tests, before a UL residential service listing will be granted. One of the water distribution test requirements for sidewall sprinklers under UL 1626 is that such sprinklers provide a uniformly high distribution pattern within 28 inches of the ceiling with one sprinkler, all around a test room of a size equivalent to the protected area or "design" area being claimed for coverage (e.g., 12'×12', etc.). Another requirement is that each wall of the test room receive at least five percent (5%) of the discharged water. Also, each square foot of the design or protected area shall receive at least 0.02 gallons per minute at the minimum discharge rate and pressure. Additional requirements are set forth for minimum distribution of water on each square foot of the design area including additional water delivery to the remote opposing corners of the room. The Sep. 30, 1994 version of the Second Edition of UL 1626 is incorporated by reference herein.

In most, if not all sidewall sprinklers, water directed at the far wall and side walls most remote from the head come from above the horizontal center line of the sprinkler. Water from below the horizontal center line is used to cover the near wall(s) and near floor. As a result, the half of the water from above the horizontal centerline is used to satisfy roughly two-thirds to three-quarters of the water density distribution requirements while the half of the water from below the horizontal center line is being used to fulfill the remainder of the distribution requirements of the protected area.

It can be particularly difficult to spray sufficient water into the center of the far wall directly opposite the sprinkler head while still covering the side walls and far corners from the head. In conventional sidewall sprinkler designs, the frame boss and a load screw in the frame boss are located along the axial center line of the sprinkler and act together as a deflector cone to distribute water radially outwardly from the center line of the sprinkler. A portion of the water directed upwardly passes through a space between the face and canopy portions. The canopy redirects this water back down in a more generally axial direction towards the opposing wall and distant portions of the sidewalls, including the remote corners. The remainder of the water is deflected by the generally vertical face portion of the deflector back to the wall supporting the sprinkler and sideways to the near side walls and the near floor area to either side and in front of the sprinkler. The requirement that water be delivered uniformly across the room from the sprinklers essentially requires that the canopy portion be planar. This leaves only a small space between the upper side of the frame boss and lower side of the canopy through which water can pass and be directed to the far side of the room directly opposite the sprinkler.

U.S. Pat. No. 4,296,816 attempts to solve these problems by providing a raised area in the center of the generally horizontal canopy portion of the deflector to channel water into the area directly opposite the sprinkler. One of the drawbacks of this approach is that the water drawn into the raised portion of the deflector comes from above the center line of the sprinkler. Accordingly, while there may be a better distribution of water including more water directed axially from the sprinkler directly opposite the sprinkler, there is still a noticeable discrepancy between the amount of water being delivered near the sprinkler and the amount being delivered to the remote areas of the room farthest away from the sprinkler.

It would be commercially valuable to improve water distribution to a remote wall opposite a sidewall mounted sprinkler in a manner which avoids using the technology of the aforesaid U.S. Pat. No. 4,296,816.

It would also be desirable to more asymmetrically divide the water being discharged from the frame so that more water is directed above the horizontal center line of the sprinkler frame to the remote portions of the protected area than is directed below the center line to the portions of the protected area closest to the sprinkler.

SUMMARY OF THE INVENTION

In one aspect the invention is, in a sidewall sprinkler head comprising a tubular body and a deflector supported from the tubular body, the tubular body including an internal passageway and a central axis extending centrally through the passageway, the deflector including a face portion supported from the tubular body spaced away from and facing one end of the tubular body and oriented transversely to the central axis, and a canopy portion supported on one side of the central axis adjoining and spaced radially away from a side edge of the face portion, an improvement wherein the deflector includes a fin portion located on another side of the central axis opposite the one side, the fin portion extending transversely to the face portion, the fin portion and the face portion fully surrounding and defining a closed perimeter of an internal opening extending axially through the deflector.

In another aspect the invention is, in a sidewall sprinkler head comprising a tubular body and a deflector supported from the tubular body, the tubular body including an internal passageway and a central axis extending centrally through the passageway, the deflector including a first, at least substantially planar face portion supported from the tubular body spaced away from and facing one end of the tubular body and oriented generally transversely to the central axis, and a second, at least substantially planar canopy portion supported on one side of the central axis adjoining and spaced radially away from a side edge of the face portion, an improvement wherein the deflector includes on another side of the central axis opposite the one side, an opening extending completely through the face portion of the deflector and a fin portion extending transversely to the face portion and being located proximally to the opening, the fin portion having a major surface shaped and oriented to deflect at least some of any liquid discharged from the one end of the tubular body, which strikes the major surface, through the opening and generally axially away from the sprinkler.

In yet another aspect the invention is, in a sidewall sprinkler head comprising a tubular body and a deflector supported from the tubular body, the tubular body including an internal passageway and a central axis extending centrally through the passageway, the deflector including a first, at least substantially planar face portion supported from the tubular body spaced away from and facing one end of the tubular body and oriented generally transversely to the central axis, and a second, at least substantially planar canopy portion supported on one side of the central axis adjoining and spaced away from a side edge of the face portion, an improvement wherein the deflector includes on another side of the central axis opposite the one side, an opening extending completely through the face portion of the deflector and a fin portion extending transversely to the face portion and being located proximally to the opening, the fin portion having a major surface shaped and oriented to deflect at least some of any liquid discharged from the one end of the tubular body, which passes through the opening and strikes the major surface, generally axially away from the sprinkler.

In yet another aspect the invention is, in a sidewall sprinkler head comprising a frame and a deflector supported from the frame, the frame including a tubular body with an internal passageway having a central axis and at least a pair of arms extending away from one end of the body and the passageway, the pair of arms supporting the deflector at a position spaced away from the one end of the body and the internal passageway, centers of the arms and the central axis defining an imaginary first plane which divides the sprinkler frame in two, the deflector including a first at least substantially planar face portion supported by the pair of arms so as to be oriented generally transversely to the first plane, facing and spaced away from the one end of the tubular body, and a second at least substantially planar canopy portion supported from the face portion on one side of the first plane adjoining and spaced away from a side edge of the face portion, an improvement wherein the deflector includes a fin portion located on another side of the first plane opposite the one side, the fin portion being supported on the face portion extending transversely to the face portion, the fin portion including a major surface facing the central axis, the fin portion major surface being shaped and oriented to deflect some of any liquid discharged from the one end of the frame body generally axially away from the deflector and the frame and radially towards the imaginary first plane and the one side of the first plane.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
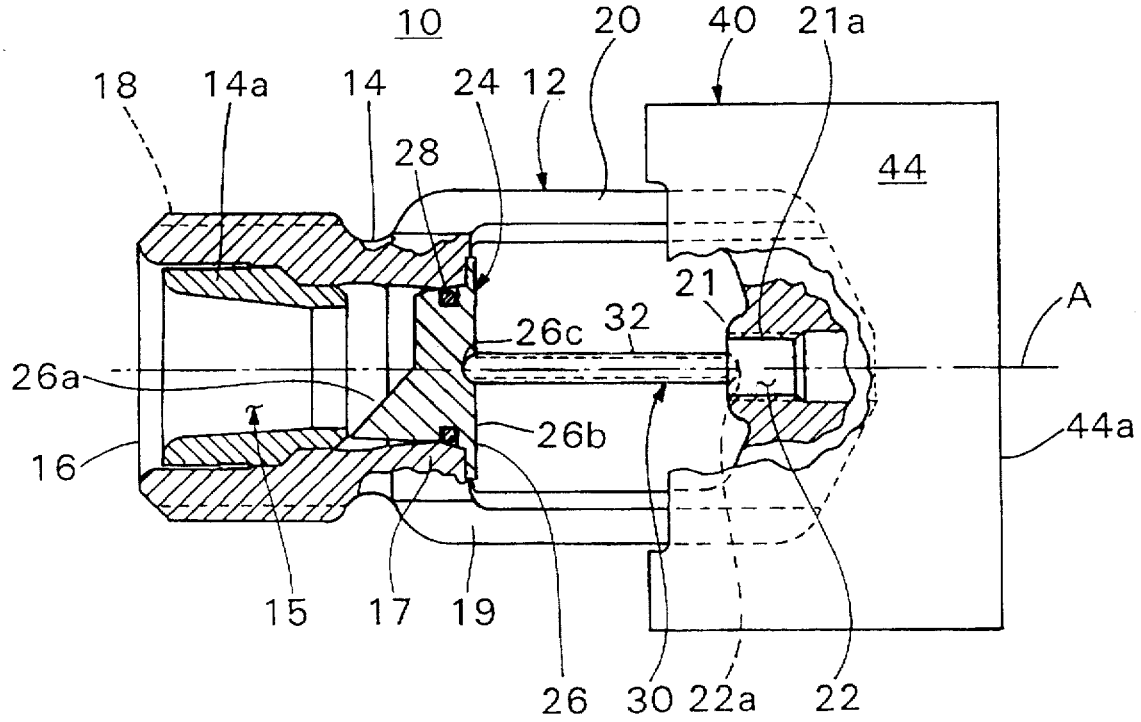
FIG. 1 is a partially broken away top plan view of a sidewall sprinkler head of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the sprinkler and designated parts thereof. The terminology includes the words above specifically mentioned, derivatives thereof and words of similar import.

In the drawings, like numerals are used to indicate like elements throughout.

Figure 2:
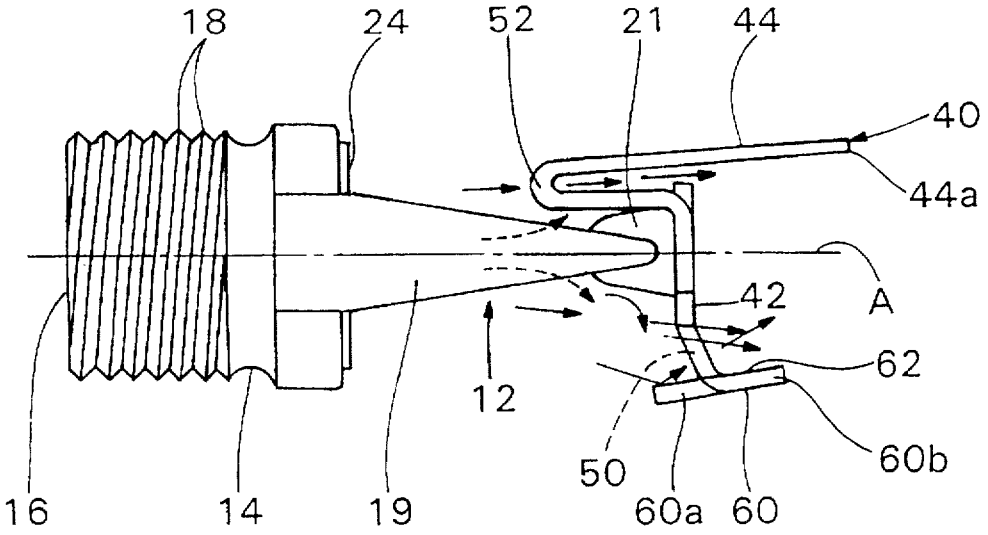
FIG. 2 is a partially broken away side elevation of the sprinkler head of FIG. 1.

FIGS. 1 and 2 depict an improved sidewall sprinkler head of the present invention indicated generally at 10. Head 10 includes a frame 12, a closure 24, a heat responsive element 30 and a deflector 40 supported from the frame 12. The frame 12 includes a tubular body 14 having a preferably centrally located, internal passageway 15 that extends between an inlet end 16 and a discharge end 17 of the body 14. The external surface of the body 14 is provided with threads 18 (schematic in FIG. 1) extending from the inlet end 16 so as to adapt the sprinkler 10 to be threaded onto a fire extinguishing liquid supply line (not depicted). The frame 12 further includes a pair of mirror image arms 19 and 20, which extend generally outwardly away from the discharge end 17 of the body 14 and the passageway 15. The pair of arms 19 and 20 preferably come together to form a "knuckle" or "joint" or boss 21. A central threaded bore **21*a* extends through the boss 21 and receives a load screw 22. The sprinkler 10 and the frame 12 have a common central axis "A", which extends centrally through the passageway 15, symmetrically between the arms 19 and 20 and centrally through the threaded bore 21*a* of boss 21. The centers of the arms 19 and 20 and central axis A further define an imaginary first plane which extends coextensively with the central axis. In the depicted preferred embodiment of frame 12, the imaginary first plane is a plane of symmetry which divides each of the arms 19 and 20 and the frame 12 in two mirror image halves. This imaginary first plane is parallel to the plane of FIG. 1 and extends perpendicularly into and out of the plane of FIG. 2 along the central axis A. It is further indicated at A' in FIG. 3. Sprinkler 10** has an imaginary second plane indicated at B in FIG. 3. The imaginary second plane is the plane of FIG. 4 and is defined, in part, by lines 4—4 of FIG. 3.

Closure 24 is positioned at the discharge end 17 of the body 14 to close that end of the internal passageway 15. Closure 24 is preferably provided by a plug 26, a portion **26*a* of which is received in the internal passageway 15 and a portion 26b of which overlaps the discharge end 17 of the internal passageway 15. A seal member 28, preferably in a form of a flexible O-ring, is provided to complete the closure 24**.

The plug 26 is retained in the passageway 15 by the heat responsive element 30, which is positioned between the closure 24 and load screw 22 in the boss 21. More particularly, the element 30 is provided by an elongated glass bulb 32 one end of which is preferably received in a depression 26c provided in the exposed end face of the plug 26. An opposing end of the bulb is received in a similar depression 22a in the end of the load screw 22 facing the body 14. The bulb 32 is hollow and contains a liquid, typically alcohol based, which expands when heated in a predictable, predetermined manner such that the bulb 32 is broken when the element 30 is exposed to at least a predetermined operating temperature for a predetermined period of time.

The deflector 40 includes a first, face portion 42, which is supported directly from the arms 19 and 20 through the screw boss 21 facing and spaced away from the discharge end 17 of the frame body 14 and its internal passageway 15. The face portion 42 is typically at least generally or substantially planar and vertical. The preferred face portion 42 is at least essentially planar and vertical when the sprinkler 10 is appropriately installed on a side wall of a room or building. The deflector 40 further includes a canopy portion 44. The canopy portion 44 is also typically at least substantially or generally planar and is supported from the face portion 42, oriented generally perpendicularly with the imaginary second plane B and transversely to the face portion 42. The preferred canopy portion 44 is essentially planar and is located on an upper side of the imaginary first plane adjoining but spaced radially away from an upper side edge 42a of the face portion 42. Preferably, the canopy portion 44 also is oriented nearly horizontal when the sprinkler 10 is appropriately installed. The planar canopy is preferably slightly pitched with respect to the horizontal (e.g. bubble level) position such that the far or remote end 44a of the canopy portion 44 is preferably tilted upwardly from the central axis A and imaginary first plane A', to provide or permit some rise in the discharged liquid.

Figure 5:
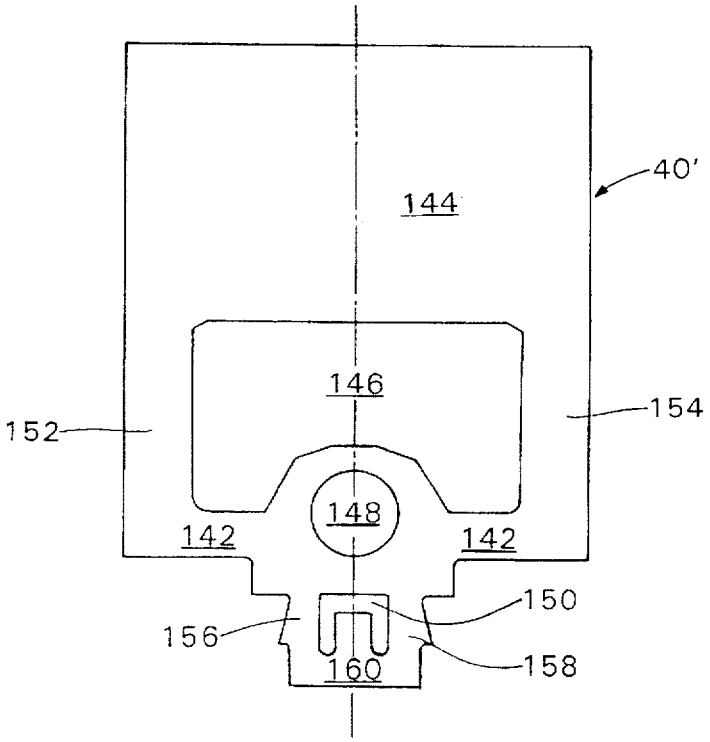
FIG. 5 is a schematic plan view of a deflector blank before shaping.

The deflector 40 is preferably produced from a flat sheet of a suitable metal, such as an approximately 40 mils thick sheet of 90/10 bronze (alloy 220) having an RB 60–70 hardness, by stamping and bending operations. A stamped blank 40' is shown in FIG. 5 before bending. The blank 40' has three internal openings: a first, relatively large, nearly rectangular opening 146, a second, circular opening 148, which is centrally aligned with the first opening 146 on one side of that opening, and a third, generally inverted U-shaped opening 150, which is centrally aligned with the first two openings 146 and 148 on an opposing side of the second opening 148 from the first opening 146. A pair of strips 152 and 154 of the blank 40' define opposing lateral side edges of the first opening 146 and couple a face portion 142 of the blank containing the second and third openings 148 and 150 with a portion 144 of the blank 40', which eventually defines the canopy.

Figure 4:
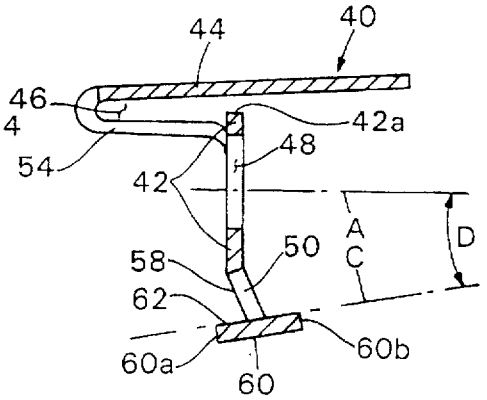
FIG. 4 is a cross-sectional view of the deflector taken along the lines 4—4 of FIG. 3.

As is best seen in FIGS. 2 and 4, the strips 152 and 154 of blank 40 are first bent away from the face portion 42 towards the frame body 14 and then are bent reversely away from the body 14 to form bent arms 52 and 54, which support the canopy portion 44 extending generally axially away from the body 14. Arms 52, 54 support the canopy portion 44 from the face portion 42 adjoining, yet spaced radially away from the upper side edge 42a of the face portion.

The original first opening 146 in blank 40' is distorted by the bending of the strips 152 and 154, but a significant opening 46 remains in the final deflector 40. The depicted opening 46 lies entirely above the central axis A and the imaginary first plane A' in FIGS. 2–4 but need not be so located and could extend down below the central axis.

The second opening 148 receives the end of the boss 21, which is swaged over the face portion 42 of the deflector 40 to fixedly secure the deflector 40 to the boss 21.

The third opening 150 on the blank 40' defines a second pair of adjoining arms 156 and 158 of the face portion 142, which support a remainder 160 of the blank 40' from the face portion 142. According to the present invention, remainder 160 is bent transversely with respect to the plane of the blank 40' to define a fin portion 60 of the deflector 40. Fin portion 60 extends generally transversely to the face portion 42 and projects transversely outwardly from the face portion 42, from either opposing major side of the face portion, towards and away from the frame 12 and tubular body 14. The end of the remainder 160 of the blank 40' which is closest to the second opening 148 and which is surrounded by the third opening 150, is bent generally back towards the frame body 14 while the extreme remote end of the blank 40' is bent generally away from the frame body 14.

The result is a generally rectangular internal opening 50 located on another side of the control axis A, opposite the one side with the canopy portion 44. Opening 50 extends axially through the bottom center of face portion 42 of the deflector 40. The fin portion 60 is located proximal to the opening 50, preferably defining one side of the opening 50, namely the lower side, which is located most remotely from the central axis A and imaginary first plane A'. The fin portion 60 and face portion 42 surround and define the closed, generally rectangular perimeter of the third internal opening 150/50.

The fin portion 60 has a major upper surface 62. Surface 62 is shaped and oriented to deflect at least some of any liquid discharged from the discharge end 17 of the tubular body 14 which strikes the major surface 62, more generally axially than radially away from the frame 12 and preferably essentially axially away from the frame 12. The part 60a of the fin portion 60 which projects generally towards the frame 12 deflects water through the opening 50 and generally axially away from the deflector 40. The part of the fin portion 60, which projects generally away from the frame 12, deflects the water passing through the opening 50 without first striking the fin portion 60 generally axially away from the deflector. Water may be deflected by the fin portion major surface 62 generally parallel to the central axis A and the imaginary first plane A' or, preferably, back up towards the central axis A and the imaginary first plane A', and even across the axis A and imaginary first plane A' toward the one (upper) side of the plane A' so as to carry to the far side of any protected area axially opposite the sprinkler head 10. The passage of liquid around the boss 21 and through the upper and lower openings 46 and 50 is indicated by the unnumbered arrows in FIG. 2.

The sprinkler 10 is installed on or adjoining a vertical side wall of a house or structure being protected (not depicted) with the face portion 42 of deflector 40 oriented at least generally and preferably essentially vertically and with the canopy portion 44 oriented generally horizontally and located above the face portion 42. Central axis A is horizontal while imaginary planes A' and B are horizontal and vertical, respectively, through axis A. Part of any liquid discharged from the discharge end 17 of the frame body 14 downwardly below the imaginary central plane A' strikes the fin portion surface 62 and is directed at least generally axially and, preferably, even upwardly towards and across that plane A' and the central axis A to carry to an opposite side of the room or any other internal space to be protected by the sprinkler head 10.

Figure 3:
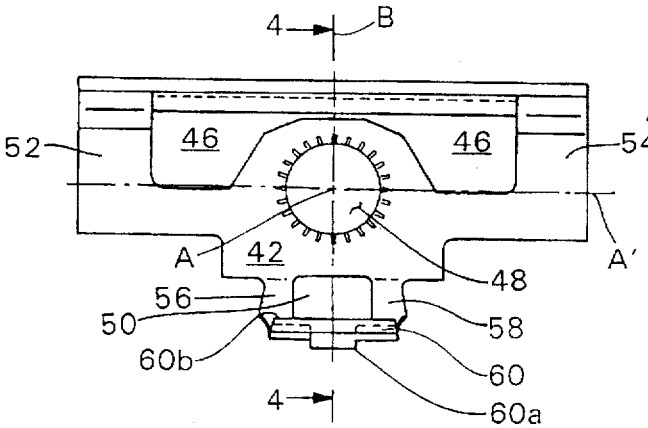
FIG. 3 is an end view of the deflector of the sprinkler of FIGS. 1 and 2 looking at a side of the deflector facing away from the body or frame of the sprinkler.

As best seen in FIGS. 3 and 4, the three openings 46, 48 and 50 of the deflector 40 are linearly (vertically) aligned on the deflector 40 with each located along and preferably bisected by the imaginary second plane B. The imaginary second plane further extends through the fin portion 60, preferably bisecting the major surface 62 and the fin portion 60 itself.

Still referring to FIG. 4, the major surface 62 of the fin portion is preferably planar but could be formed in a non-planar shape, if desired. A central axis C of the fin portion major surface 62, which lies in the plane of FIG. 4, and is tangent to the far end of the surface 62 most remote from frame 12, can be oriented at any angle from +45° parallel to −45° with respect to the central axis A, depending upon where the fin portion 60 is positioned to catch and deflect discharged liquid and where that deflected water is to be directed. Preferably the end of the fin portion 60 farthest from (most distal to) the frame 12 suggestedly is parallel to (i.e., 0° angle with) or pitched upwardly towards the central axis A at an angle of up to about 20° with respect to the central axis A and, preferably, is pitched upwardly an angle "D" of about 10° with respect to that central axis A. The lower opening 50 may be about two-tenths of an inch wide in the horizontal direction and about one-eighth of an inch high.

The installation and operation of the sidewall sprinkler head 10 is conventional. When the sprinkler head 10 is activated by breakage of the heat responsive element 30, water or other fire extinguishment liquid flows through the internal passageway 15 and is discharged from end 17 towards the boss 21, load screw 22 and deflector 40. Water is discharged axially from end 17 uniformly around axis A. Some water is deflected from the load screw and boss generally radially outwardly around central axis A. The upper half of the discharged water which passes between support arm 56 and 58, either passes directly through the central opening 46 or contacts and is directed by the canopy portion 44 through the opening. The canopy directs water passing through the first upper opening 46 towards the opposing wall and corners of the room or other protected area most remote from the sprinkler head 10.

Normally the lower half of the discharged water would strike the lower portion of the boss 21 and/or a solid face portion of the deflector below the boss 21 and would be reflected back towards the adjoining wall supporting the sprinkler 10 and the area immediately below and to the sides of the sprinkler. However, the fin portion 60 of the deflector 40 is preferably positioned to receive a significant flow of water either directly from the discharge end 17 of the body 14 to maintain its momentum or deflected from the lower side of the boss 21. The near part **60*a* of fin portion 60 can receive water deflected from the boss 21 as well as directly from the discharge end 17 of the frame 12. The distal part 60*b* of the fin portion 60 receives some of the discharged liquid passing directly from the discharge end 17 of frame 12 through opening 50. The fin portion major surface 62 directs water striking it generally axially away from the sprinkler 10, and preferably back up towards the imaginary central plane A' and central axis A, and even across that plane and axis toward the opposing, upper side of the plane A', so as to strike the wall of the room or the remote floor area directly axially opposite the sprinkler head 10**.

As a specific example, a sprinkler head 10 as described above has been constructed with a tubular body 14. A nominal orifice size of ⅜" (9.53 mm) and a discharge coefficient or K-Factor of 3.5, which is equal to the flow of water through the tubular body 14 in gallons per minute divided by the square root of the pressure of water supplied to the inlet end 16 of the body 14 in pounds per square inch gauge are provided in the tubular body 14 by means of an insert **14*a*. The release element 30 is preferably a conventional 3 mm diameter frangible bulb about 2 cm in length having, for example, either a 155° F./68° C. or a 175° F./79° C. temperature rating. An individual sprinkler 10 pressurized to provide minimum design flows of 14 gallons per minute (16.0 psi) provided satisfactory water distribution over 12'×12' and 14'×14' coverage areas when the deflector was located within 4 to 12 inches of a generally smooth ceiling, in accordance with UL 1626. When pressurized to supply a minimum design flow of 16 gallons per minute (21 psi), satisfactory distribution was achieved with a single sprinkler 10 over a 16'×16' coverage area when the deflector 40** was located approximately 4 to 6 inches below a generally smooth ceiling, also in accordance with UL 1626. (The other requirements of UL 1626 have also been met by this sprinkler). The preferred embodiment sprinkler has the lowest required flow rates (GPM) of any known sidewall sprinklers for "small" residential areas (e.g., 6'×6' or smaller).

While a preferred embodiment has disclosed, it will be appreciated by those skilled in the art that modifications to this preferred embodiment could be made. For example, while the disclosed frame is a one-piece, machined casting, it could easily be made of a body and separate arms. The arms of the frame do not have to come together to form a boss and the boss could be replaced by a deflecting cone or shaped center of the deflector face portion. While the frame arms are preferably horizontally oriented when the sprinkler is installed, the sprinkler could be designed with the arms vertically oriented.

While a plug-type enclosure is shown, alternate types, such as a cap or saddle over the discharge end of the tubular body could be used. While a bulb type heat responsive element is preferred, numerous other types of heat responsive elements include solder bonded levers, bulb separated levers, levers held together with solder bonded links, solder supported telescopic members and even shaped memory alloy actuators, as well as other elements which may be designed in the future, could be used with such sprinklers.

While the fin portion is preferably located along a vertical central plane through the deflector 40, plural fin portions could be provided along the central vertical plane or on either side of the central vertical plane, or both, to distribute water not only to the area directly axially opposite the sprinkler but into the far remote corners of the defined protected area of the sprinkler. While the fin portion support arms 156 and 158 are generally transverse to the central vertical plane, they could be bent to more nearly parallel a central vertical plane extending longitudinally through the sprinkler (the imaginary second plane) to provide a reduced cross-section to water striking them or to further act as auxiliary fin portion surfaces redirecting water through the lower opening(s) to the directly opposite and/or remote corners of the protected area. While the lower and larger end of the remainder 160 of the blank 40' was bent "forward" and away from the sprinkler body in defining the fin portion 60, it could be bent in an opposite, "backward" direction axially closer to the sprinkler body. While the preferred fin portion major surface 62 is planar, it can be curved and/or otherwise non-planarly shaped to more specifically direct water than can be done with a planar fin portion surface. While the third opening 150 is generally rectangular it could assume other shapes e.g. triangular, oval or otherwise curved, regular or irregular. While the third opening 150 is located entirely below the central imaginary plane A' opposite the canopy portion of the deflector, portions of the opening can extend above that plane. While opening 150 has a closed perimeter, the perimeter need not be fully closed. For example, the fin portion 60 could be divided longitudinally into two side-by-side segments with a space therebetween.

It will be appreciated by those skilled in the art that still other changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. In a sidewall sprinkler head comprising a tubular body and a deflector supported from the tubular body, the tubular body including an internal passageway and a central axis extending centrally through the passageway, the deflector including a face portion supported from the tubular body spaced away from and facing one end of the tubular body and oriented transversely to the central axis, and a canopy portion supported on one side of the central axis adjoining and spaced radially away from a side edge of the face portion, an improvement wherein the deflector includes a fin portion located on another side of the central axis opposite the one side, the fin portion extending transversely to the face portion, the fin portion and the face portion fully surrounding and defining a closed perimeter of an internal opening extending axially through the deflector.

2. The improvement of claim 1 wherein the sprinkler has an imaginary first plane, which extends coextensively along the central axis and through the face portion of the deflector, and wherein the opening is located along an imaginary second plane, the second imaginary plane extending along the central axis perpendicularly to the first plane and to the canopy portion.

3. The improvement of claim 2 wherein the second plane intersects the fin portion.

4. The improvement of claim 3 wherein the second plane bisects the fin portion.

5. The improvement of claim 3 wherein the fin portion includes a major surface facing the central axis, the major surface of the fin portion being pitched at an angle of between 0° and about 45° with respect to the central axis.

6. The improvement of claim 5 wherein the major surface of the fin portion is pitched at an angle of between 0° and about 20° with respect to the central axis.

7. The improvement of claim 5 wherein the major surface of the fin portion surface is pitched at an angle of about 10° with respect to the central axis.

8. The improvement of claim 1 wherein the fin portion extends transversely through the opening and projects outwardly from the face portion generally towards and away from the tubular body.

9. The improvement of claim 1 wherein the fin portion is located on a side of the opening most remote from the central axis.

10. The improvement of claim 1 wherein at least part of the fin portion projects transversely from the face portion generally towards the tubular body.

11. The improvement of claim 9 wherein at least part of the fin portion projects transversely from the face portion generally away from the tubular body.

12. The improvement of claim 11 wherein at least part of the fin portion projects transversely from the face portion generally towards the tubular body.

13. The improvement of claim 1 wherein at least the face portion and the fin portion of the deflector are formed from a single sheet of material.

14. The improvement of claim 13 wherein the fin portion is formed by part of the single sheet of material being turned transversely away from an adjoining part of the single sheet of material defining the face portion.

15. In a sidewall sprinkler head comprising a tubular body and a deflector supported from the tubular body, the tubular body including an internal passageway and a central axis extending centrally through the passageway, the deflector including a first, at least substantially planar face portion supported from the tubular body spaced away from and facing one end of the tubular body and oriented generally transversely to the central axis, and a second, at least substantially planar canopy portion supported on one side of the central axis adjoining and spaced radially away from a side edge of the face portion, an improvement wherein the deflector includes on another side of the central axis opposite the one side, an opening extending completely through the face portion of the deflector and a fin portion extending transversely to the face portion and being located proximally to the opening, the fin portion having a major surface shaped and oriented to deflect at least some of any liquid discharged from the one end of the tubular body, which strikes the major surface, through the opening and generally axially away from the sprinkler.

16. In a sidewall sprinkler head comprising a tubular body and a deflector supported from the tubular body, the tubular body including an internal passageway and a central axis extending centrally through the passageway, the deflector including a first, at least substantially planar face portion supported from the tubular body spaced away from and facing one end of the tubular body and oriented generally transversely to the central axis, and a second, at least substantially planar canopy portion supported on one side of the central axis adjoining and spaced away from a side edge of the face portion, an improvement wherein the deflector includes on another side of the central axis opposite the one side, an opening extending completely through the face portion of the deflector and a fin portion extending transversely to the face portion and being located proximally to the opening, the fin portion having a major surface shaped and oriented to deflect at least some of any liquid discharged from the one end of the tubular body, which passes through the opening and strikes the major surface, generally axially away from the sprinkler.

17. In a sidewall sprinkler head comprising a frame and a deflector supported from the frame, the frame including a tubular body with an internal passageway having a central axis and at least a pair of arms extending away from one end of the body and the passageway, the pair of arms supporting the deflector at a position spaced away from the one end of the body and the internal passageway, centers of the arms and the central axis defining an imaginary first plane which divides the sprinkler frame in two, the deflector including a first at least substantially planar face portion supported by the pair of arms so as to be oriented generally transversely to the first plane, facing and spaced away from the one end of the tubular body, and a second at least substantially planar canopy portion supported from the face portion on one side of the first plane adjoining and spaced away from a side edge of the face portion, an improvement wherein the deflector includes a fin portion located on another side of the first plane opposite the one side, the fin portion being supported on the face portion extending transversely to the face portion, the fin portion including a major surface facing the central axis, the fin portion major surface being shaped and oriented to deflect some of any liquid discharged from the one end of the frame body generally axially away from the deflector and the frame and radially towards the imaginary first plane and the one side of the first plane.

18. The improvement of claim 17 wherein the deflector face portion includes an internal opening with a closed perimeter and wherein the fin portion defines part of the closed perimeter of the internal opening.

19. The improvement of claim 18 wherein the internal opening lies entirely on the other side of the first imaginary plane opposite the one side.

20. The improvement of claim 17 wherein the fin portion extends transversely from opposing major sides of the face portion.

* * * * *